US006592778B2

(12) United States Patent
Zeuner et al.

(10) Patent No.: US 6,592,778 B2
(45) Date of Patent: Jul. 15, 2003

(54) METHOD FOR PRODUCING PROPELLANT COMPACTS

(75) Inventors: Siegfried Zeuner, München (DE); Achim Hofmann, Polling (DE); Roland Schropp, Tegernheim (DE); Karl-Heinz Rödig, Kraiburg (DE)

(73) Assignee: TRW Airbag Systems GmbH & Co. KG, Aschau/Inn (DE)

( * ) Notice: Subject to any disclaimer, the term of this patent is extended or adjusted under 35 U.S.C. 154(b) by 81 days.

(21) Appl. No.: 09/798,528

(22) Filed: Mar. 2, 2001

(65) Prior Publication Data

US 2001/0018812 A1 Sep. 6, 2001

(30) Foreign Application Priority Data

Mar. 1, 2000 (DE) ..... 100 09 819

(51) Int. Cl.[7] ..... C09K 3/00

(52) U.S. Cl. ..... 252/188.1; 149/2; 149/38; 149/39; 264/3.1

(58) Field of Search ..... 149/2, 38, 39; 264/3.1; 252/188.1

(56) References Cited

U.S. PATENT DOCUMENTS

| | | | | |
|---|---|---|---|---|
| 4,001,060 A | | 1/1977 | Staba | |
| 4,207,125 A | | 6/1980 | Grant | |
| 5,230,841 A | * | 7/1993 | Redecker et al. | 264/3.1 |
| 5,670,098 A | | 9/1997 | Dillehay et al. | |

FOREIGN PATENT DOCUMENTS

| | | |
|---|---|---|
| DE | 3820443 | 12/1988 |
| DE | 2753555 | 9/1990 |
| DE | 4012294 | 2/1991 |
| DE | 4235646 | 4/1994 |
| DE | 68922162 | 8/1995 |
| DE | 4432826 | 4/1996 |
| WO | 9517358 | 6/1995 |

* cited by examiner

*Primary Examiner*—Cephia D. Toomer
(74) *Attorney, Agent, or Firm*—Tarolli, Sundheim, Covell & Tummino L.L.P.

(57) ABSTRACT

The invention relates to a method for producing propellant compacts for use in gas generators for safety devices in motor vehicles by extrusion, comprising the following steps:

mixing the constituents of the propellant and stirring the mixture into a paste with a solvent so as to form a plasticizable mass, extruding the plasticizable mass in order to form propellant compacts, and drying the propellant compacts in order to remove the solvent, a thickening agent which increases the viscosity being added to the solvent prior to pasting in a proportion of from 0.1 to 10% by weight, relative to the solvent, and the dried propellant compacts having a density of at least 70% of the theoretical density. The invention further relates to propellant compacts obtainable in accordance with this method.

22 Claims, No Drawings

METHOD FOR PRODUCING PROPELLANT COMPACTS

The invention relates to a method for producing dense propellant compacts for use in gas generators for safety devices in motor vehicles by extrusion. The invention further relates to a dense propellant compact for use in gas generators for safety devices in motor vehicles, obtainable by an extrusion method according to the invention.

Propellant compacts, also known as pellets, are used as gas-producing means in gas generators of safety devices in motor vehicles. The advantage of the extrusion process as compared with pressing pellets from dry, finely ground raw materials is that it is not subject to any restriction with respect to the shaping of the pellets and thus allows the combustion characteristics to be set as desired.

In view of the risk of spontaneous ignition, however, care must be taken during the extrusion to extrude the propellant with as little thermal and mechanical stressing as possible.

In order to produce propellant compacts by extrusion, it is necessary for the extruded mass to have a certain degree of plasticity. For this purpose, in previous methods the propellant is mixed with a binder in addition to a solvent. In this case the proportion of binder is rarely below 12 to 15%. The binders used are generally polymers, hydrocarbons or silicones which have a very negative oxygen balance. This makes it necessary to increase the oxidant proportion in the mass. It is also known to use inorganic binders such as bentonites, which results, however, in a sharp reduction in the combustion rate.

Various problems can arise in the extrusion of these plasticizable masses containing binders. Non-homogeneity of the suspension for example can occur, which is caused by a non-homogeneous distribution of the binder particles and the solvent, so as to result in an ambiguous pressure/volume-flow correlation. This leads to the extrusion pressure fluctuating in accordance with the concentration of solids.

As a result of a pressure drop above the extrusion capillary a superproportional flow of liquid through the capillary is possible, which leads to dehydration of the extrusion mass and thus to an increase in the extrusion pressure.

In addition, because of the extrusion pressure, a certain proportion of liquid can be pressed into micropores between the propellant particles and the binder particles. As a result of the reduction of the freely movable quantity of liquid the mass then becomes stiffer and the extrusion pressure further increases.

Finally, damage to the surface can occur as a result of the hardening of areas of the extrusion mass which are close to the wall. This effect occurs in particular when binders which harden are used.

The aim of the present invention is to provide a method for extruding dense propellant compacts which avoids the drawbacks described above. This is achieved by a method which comprises the following steps:

- mixing the constituents of the propellant and stirring the mixture into a paste with a solvent so as to form a plasticizable mass;
- extruding the plasticizable mass in order to form propellant compacts; and
- drying the propellant compacts in order to remove the solvent;
- a thickening agent which increases the viscosity being added to the solvent prior to pasting in a proportion of from 0.1 to 10% by weight, relative to the solvent, and the propellant compacts having a density of at least 70% of the theoretical density.

The components of the propellant are reduced to a slurry in this viscous solvent, preferably by use of a planetary mixer or kneader, whereby a plasticizable mass is formed. It is thus possible to dispense with binders completely. Since the solvent itself has a viscosity increased by the addition of the thickening agent, the dehydration effect described above is reduced. For the same reason less solvent penetrates into pores between the particles of propellant, and in addition the number of the pores is reduced as a result of the fact that no binder in particle form is added.

The solvent is advantageously introduced in a proportion of from 5 to 50% by weight, relative to the propellant. It is particularly preferred for the proportion of solvent to amount to from 10 to 30% by weight, relative to the propellant. A satisfactorily extrudable mass is produced with these quantity ratios.

The thickening agent is preferably introduced in a proportion of from 1 to 5% by weight, relative to the solvent. In this way, the quantity of the thickening agent added is generally far below the quantity of the binder in the case of other extruded propellants. As a result, the recipe of the propellant and thus its combustion characteristics, its oxygen balance and its stability are altered to only a very slight degree.

In a preferred composition the proportion of the thickening agent in the propellant is less than 3% by weight after the removal of the solvent. Since the solvent is evaporated almost completely from the propellant compacts during the drying of the latter after the extrusion process, the solvent does hardly affect the recipe of the propellant. The small proportion of thickening agent, which is far below the quantity generally used when using binders, ensures that the recipe of the propellant is altered only to an insignificant extent.

Since for extruding the propellant mixture a smallest possible amount of solvent is to be used and the quantity of the thickening agent is also to be kept as small as possible, it is important that the thickening agent is added to the solvent prior to pasting the propellant mixture. Thus, the thickening agent is added to the solvent in a preliminary method step, so as to produce a mixture with high viscosity. Preferably, a jellification or a cross-linking occurs in this method step between the solvent and the thickening agent. Into this mixture of solvent and thickening agent are then introduced the propellant mixture or the single components of the propellant, preferably by use of a planetary mixer or kneader.

Adding the dry thickening agent to the propellant mixture and subsequent pasting with the solvent would, however, result in the solvent being absorbed only on the surface area of the very fine propellant components. The thickening agent which is present in small concentration anyway would then not be able to cause a change in viscosity.

The thickening agent is intended to cause a substantial increase in viscosity of the solvent so that the dehydration effect, described above, during extrusion can be prevented and the amount of thickening agent to be employed can be kept small. Suitable thickening agents have a viscosity of preferably at least 1,000 mPas, as measured in accordance with Brookfield (spindle No. 3; 20 r.p.m; room temperature) for a 1% solution in the solvent concerned. Preferably, the mixture formed from the solvent and the thickening agent has a Brookfield viscosity of at least 10,000 mPas as measured under processing conditions.

The thickening agent is preferably selected from the group consisting of the natural organic thickening agents, the modified organic thickening agents, as well as the fully synthetic organic thickening agents. It is particularly preferred to use the natural organic thickening agents from the group consisting of alginates, agar-agar, arabicum, carragheen, casein, dextrins, furcellaran, gelatins, ghatti gum, guar seed flour, carob seed flour, karaya gum, konjak, pectins, arrowroot, polyoses, tamarind flour, tara seed flour, tragacanth gum and xanthan gum. These are easily obtainable substances which burn without harmful environmental effects.

It is likewise preferred to use the modified organic thickening agents selected from the group consisting of carboxymethylcellulose, cellulose ether, hydroxyethylcellulose, hydroxypropylcellulose and seed flour ether. It is particularly preferred to use hydroxyethylcellulose. These substances too are easily obtainable, can be satisfactorily handled and do not produce any substances injurious to humans when burnt.

The fully synthetic organic thickening agents are preferably selected from the group consisting of polyacrylic compounds, polymethacrylic compounds, vinyl polymers, polycarboxylic acids, polyethers, polyimines and polyamides.

The solvent is preferably selected from the group consisting of water, alcohols, ethers, aldehydes, ketones, carboxylic acids, carboxylic acid esters, carboxylic acid amides, amines and ammonia as well as mixtures thereof. With these substances which evaporate largely without a residue, it is possible to produce extrudable masses according to the invention in conjunction with the preferred thickening agents mentioned above.

Water, alcohol or a water/alcohol mixture is preferably used as the solvent. It is most preferred to use water as the solvent. Ethyl alcohol is the most preferred alcohol. These solvents are inexpensive, harmless and simple to handle.

The propellant is advantageously a mixture of guanidine nitrate, copper oxide (CuO), basic copper nitrate, ammonium perchlorate (APC), sodium nitrate and iron oxide ($Fe_2O_3$). Together with one of the above-mentioned thickening agents, and in particular preferably with hydroxyethylcellulose and the addition of water, a plasticizable mass can be produced from which propellant compacts can be extruded.

The propellant compacts, extruded and dried after extrusion in accordance with the invention, have a density of at least 70%, preferably at least 80%, of the theoretical density, i.e. the density which is normally achieved upon dry compressing the ground propellant components. The combustion behavior of the compacts obtained in this way is, thus, much better reproducible than the combustion behavior of porous extrudates.

Further features and advantages of the invention may be seen in the following description of an embodiment.

EXAMPLE

A propellant mixture comprised of 45.57 parts of guanidine nitrate, 12.65 parts of copper oxide, 24.48 parts of basic copper nitrate, 4.11 parts of ammonium perchlorate, 3.01 parts of sodium nitrate and 9.69 parts of iron oxide ($Fe_2O_3$) was pasted in water with 24 parts of a 2% solution of hydroxyethylcellulose (m.w.: 1,500,000).

The hydroxyethylcellulose used had a viscosity of from 3,500 to 5,500 mPas, as measured in accordance with Brookfield (spindle No. 3; 20 r.p.m; at room temperature), for a 1% solution in water.

Pasting the mixture was done in a planetary mixer by introducing the propellant mixture into the hydroxyethylcellulose solution, with formation of a plasticizable mass. This mass was extruded in a single-screw extruder with a diameter of 19 mm. In this case round casting nozzles of a diameter of 4 mm and a rotational speed of 20 r.p.m. were used at a pressure of 30 bar. The propellant compacts were then dried.

For producing single-hole compacts, extruding the propellant mixture can also be carried out with the use of a pipe die having a diameter of 5/1 mm at 60 r.p.m. and a pressure of approximately 50 bar.

The density of the propellant extruded and dried in this way, at 1.86 g/cm$^3$, is about 10% lower than in the case of dry compressing of the set which has been ground, which corresponds to a density of approximately 90% of the theoretical density.

The same propellant mixture mixed with water, without the addition of hydroxyethylcellulose, displays no plasticity. The said mass prepared with pure water displays the phenomenon of dehydration as described above and cannot be extruded.

In addition, it has been found that the amount of solvent required for pasting can be significantly reduced by the addition of the thickening agent to the solvent. In the example named above a plastic mass which is visually comparable but not extrudable is produced only with the addition of about 29% by weight of the propellant mass in pure water, as compared with 24% of the water/hydroxyethylcellulose solution.

The method according to the invention is not restricted to the use of the propellant composition mentioned above. Almost any desired propellant composition can in fact be extruded with the aid of the method according to the invention.

What is claimed is:

1. A method for producing dense propellant compacts for use in gas generators for safety devices in motor vehicles by extrusion, the method comprising the following steps:

mixing the constituents of the propellant and stirring the mixture into a paste with a solvent so as to form a plasticizable mass, extruding the plasticizable mass in order to form propellant compacts, and drying the propellant compacts in order to remove the solvent, a thickening agent which increases the viscosity being added to the solvent prior to pasting in a proportion of from 0.1 to 10% by weight, relative to the solvent, and the dried propellant compacts having a density of at least 70% of the theoretical density.

2. The method according to claim 1, wherein the solvent is introduced in a proportion of from 5 to 50% by weight, relative to the propellant.

3. The method according to claim 1, wherein the solvent is introduced in a proportion of from 10 to 30% by weight, relative to the propellant.

4. The method according to claim 1, wherein the thickening agent is introduced in a proportion of from 1 to 5% by weight, relative to the solvent.

5. The method according to claim 1, wherein the proportion of the thickening agent in the propellant is less than 3% by weight after the removal of the solvent.

6. The method according to claim 1, wherein the thickening agent has a viscosity of at least 1,000 mPas, as measured in accordance with Brookfield, for a 1%-solution in the solvent.

7. The method according to claim 1, wherein the thickening agent is selected from the group consisting of the natural organic thickening agents, the modified organic thickening agents, the fully synthetic organic thickening agents and the natural inorganic thickening agents.

8. The method according to claim 7, wherein the natural organic thickening agents are selected from the group consisting of alginates, agar-agar, arabicum, carragheen, casein, dextrins, furcellaran, gelatins, ghatti gum, guar seed flour, carob seed flour, karaya gum, konjak, pectins, arrowroot, polyoses, tamarind flour, tara seed flour, tragacanth gum and xanthan gum.

9. The method according to claim 7, wherein the modified organic thickening agents are selected from the group consisting of carboxymethylcellulose, cellulose ether, hydroxyethylcellulose, hydroxypropylcellulose and seed flour ether.

10. The method according to claim 7, wherein the fully synthetic organic thickening agents are selected from the group consisting of polyacrylic compounds, polymethacrylic compounds, vinyl polymers, polycarboxylic acids, polyethers, polyimines and polyamides.

11. The method according to claim 1, wherein the thickening agent is hydroxyethylcellulose.

12. The method according to claim 1 wherein water is used as the solvent.

13. The method according to claim 1, wherein the propellant is a mixture of guanidine nitrate, copper oxide (CuO), basic copper nitrate, ammonium perchlorate (APC), sodium nitrate and iron oxide ($Fe_2O_3$).

14. A propellant compact for use in gas generators for safety devices in motor vehicles, obtainable by an extrusion method according to claim 1, the propellant compacts having a content of thickening agent less than 3% by weight, relative to the quantity of propellant, and having a density of at least 70% of the theoretical density.

15. The propellant compact according to claim 14, wherein the content of thickening agent is at most 1% by weight, relative to the quantity of propellant.

16. The propellant compact according to claim 14, wherein the content of thickening agent is at most 0.5% by weight, relative to the quantity of propellant.

17. The method according to claim 1, wherein the solvent is selected from the group consisting of water, alcohols, ethers, aldehydes, ketones, carboxylic acids, carboxylic acid esters, carboxylic acid amides, amines, and ammonia, and mixtures thereof.

18. The method according to claim 17, wherein the solvent is selected from the group consisting of water, alcohols and mixtures of water and alcohols.

19. The propellant compact of claim 14, wherein the propellant contains a guanidine compound.

20. The propellant compact according to claim 19, wherein the guanidine compound is selected from the group consisting of guanidine carbonate, guanidine nitrate, guanidine perchlorate, aminoguanidine nitrate, diaminoguanidine nitrate, triaminoguanidine nitrate, nitroguanidine and mixtures thereof.

21. The propellant compact according to claim 14, wherein the propellant contains a fuel with an enthalpy of formation of less than −3.35 kJ/g and an oxygen balance of more than −90%.

22. The propellant compact according to claim 21, wherein the fuel is selected from the group consisting of cyanuric acid, urea, oxamide, urazole, dialuric acid, biurea, alloxan, alloxantin, parabanic acid and mixtures thereof.

* * * * *